United States Patent [19]

Ohrberg

[11] 4,004,866

[45] Jan. 25, 1977

[54] GEROTOR DEVICE WITH VALVE COMPENSATING MEANS

[75] Inventor: Carl Verner Ohrberg, Nordborg, Denmark

[73] Assignee: Danfoss A/S, Nordborg, Denmark

[22] Filed: Nov. 10, 1975

[21] Appl. No.: 630,294

[30] Foreign Application Priority Data

Nov. 12, 1974 Germany ..... 2453560

[52] U.S. Cl. ..... 418/61 B; 91/433

[51] Int. Cl.[2] ..... F01C 1/02; F01C 21/12; F03C 3/00; F15B 11/10

[58] Field of Search ..... 418/61 B; 91/433; 60/384

[56] References Cited

UNITED STATES PATENTS

| | | | |
|---|---|---|---|
| 3,758,242 | 9/1973 | Ohrberg | 418/61 B |
| 3,771,905 | 11/1973 | Ohrberg et al. | 418/61 B |
| 3,841,800 | 10/1974 | Ohrberg et al. | 418/61 B |

*Primary Examiner*—John J. Vrablik

[57] ABSTRACT

The invention relates to a gerotor type of rotary piston machine which is operable as either a pump or a motor. In this type of device an externally toothed rotor member is eccentrically offset relative to an internally toothed stator member and in operation these members mesh to form expanding and contracting cells on opposite sides of the line of eccentricity. There is shaft means for driving the rotor and a distributing valve for feeding and exhausting the cells is attached to the shaft means. In order to compensate for torsion stresses in the shaft means which would cause the distributing valve to be slightly out of phase relative to the rotor the connection between the valve and the shaft means is made adjustable in response to sensing means which sense the pressure conditions in the gerotor when the rotor is symmetrical relative to the line of eccentricity. Fluid pressure operated valve and motor means are provided to position the distributing valve relative to the shaft means in accordance with the sensed pressure conditions in the gerotor.

3 Claims, 6 Drawing Figures

GEROTOR DEVICE WITH VALVE COMPENSATING MEANS

Figure 1:
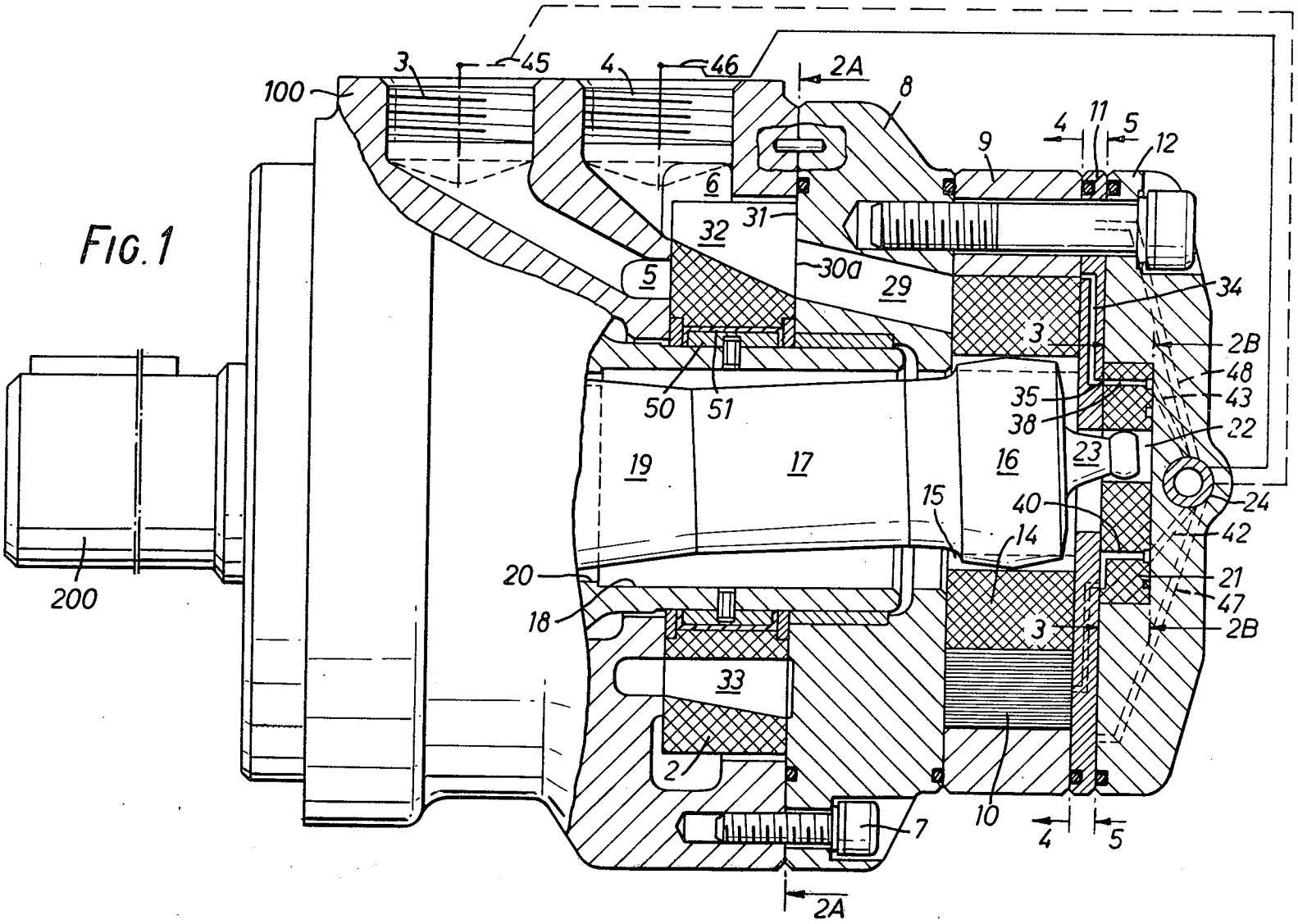

The invention relates to a rotary piston machine having parallel and internal axes, comprising displacement cells which are formed between a stator and a rotor, alternately enlarge and contract between two extreme volumes, and are connected to the connections by way of a distributing valve consisting of a valve portion fixed to the stator and a rotary slide that is fixed by a shaft to rotate with the rotor, wherein the rotary slide is adjustable through a limited angle with respect to the rotor by means of an adjusting apparatus having at least two chambers associated with each connection, particularly a circular piston machine in which a pinion enclosed by a hollow wheel is connected to the rotary slide by a cardan shaft.

In such machines, the connection between the rotary slide and the rotor by way of the shaft gives a certain amount of play. If in the case of a pump the rotary slide is connected to the driven main shaft, it precedes the rotor in the direction of rotation. If, on the other hand, the rotor takes the rotary slide with it, as is the case with a motor, the rotary slide lags behind the rotor in the direction of rotation. This precession and lag is reversed when the direction of rotation is changed. It results in the machine suffering a power loss because of incorrect control of the rotary slide.

For compensating purposes, it is known to mount the stator relatively to the associated valve portion at an angle that is offset corresponding to the angle of advance or lag. However, a prerequisite for this is that the machine rotates in only one direction.

For the purpose of compensation dependent on the direction of rotation, it is known rotatably to mount the rotary slide on a support, e.g. the machine shaft, and to provide two defined angular positions which are disposed to both sides of the neutral position by the amount of the angle of advance or lag and into which the rotary slide is automatically displaceable by a pressure-dependent adjusting apparatus. The adjusting apparatus possesses at least two chambers of which the one is permanently connected to the one connection and the other permanently to the other connection of the machine. Consequently, it is always the chamber that is connected to the pressure connection which is effective for rotating the rotary slide to its associated one end position.

This construction facilitates good but not complete compensation. For example, no account is taken of changes in the angle of advance or lag arising by reason of load-dependent torsion of the shaft section between the rotor and rotary slide or caused by wear in the rotary couplings occasioned by the period of use, e.g. the teeth at the heads of a cardan shaft. Further, in the known machine one can compensate for only a mean value of the angle of advance or lag in the case of each machine series as determined by type and size. Since not all machines of the series correspond to this mean value, there will also be incomplete compensation in this respect.

The invention is based on the object of providing a machine of the aforementioned kind that is operable in both directions of rotation, wherein the angle of advance or lag is at all times compensated practially 100 percent.

This object is achieved in accordance with the invention in that a signalling device is provided, which transmits a signal between the instant at which one of the extreme-volume displacement cells passes through the neutral position and the instant of the pressure change in this cell as caused by the distributing valve, and that the chambers of the adjusting apparatus are connectible to the connections by way of a three-position regulating valve which moves during the period of the signal impulse into its open position effecting shortening of the next impulse.

With this construction of the machine, a check is made during each pressure change in one of the extreme-volume displacement cells whether this pressure change takes place at the instant the neutral position is traversed. If this is not the case, a signal impulse is transmitted which opens the regulating valve for a short time. This causes the adjusting apparatus to be actuated in the sense of decreasing the angle of advance or lag. This is repeated until no signal impulse occurs, i.e. until complete compensation has been achieved. Since the regulating valve blocks the chambers of the adjusting apparatus in the absence of a signal impulse, this optimum condition is maintained. Should changes occur for any reason, the rotary slide is immediately adjusted correspondingly.

It is of advantage to use a pressure-actuated regulating valve which is held in the blocking position by spring force and the signal impulse is a pressure impulse which is obtained from the pressures in the machine by the signalling device and which directly actuates the regulating valve. In this way the pressures of the hydraulic operating medium that in any case exist in the machine are utilised for obtaining the signal impulse as well as for actuating the regulating valve. This results in a simple and robust construction. In addition, the period of the signal impulse is a direct measure for the size of the angle of advance or lag that is still to be compensated. However, the longer the regulating valve is held open by the signal impulse, the fewer impulses are required by the adjusting apparatus to bring the rotary slide to the central position.

In a preferred embodiment the regulating valve is adjustable by the difference in pressures in two actuating chambers and the signalling device comprises a first sensing valve which temporarily connects the one extreme volume displacement cell to the one actuating chamber and a second sensing valve which gives rise to a pressure change in the other actuating chamber at the instant of the neutral position. This is a particularly simple manner of obtaining the signal impulse and making it effective directly at the regulating valve.

Advantageously, provision is made to ensure that the first sensing valve connects the one actuating chamber to the extreme volume displacement cell that is to be switched from low pressure or suction to pressure, i.e. the displacement cell of smallest volume in the case of a motor, and the second sensing valve connects in the neutral position a hitherto closed conduit that leads to the othe actuating chamber to a pressurised displacement cell. This results in the start of the pressure impulse being predetermined by the one actuating chamber receiving pressure and the end of the pressure impulse being determined by the other actuating chamber also receiving pressure. When the two sensing valves are then closed again, the two actuating chambers are closed and the sensing valve remains in its neutral or closing position until the next pressure impulse.

Further, the first and second sensing valve may comprise a common valve plate driven at the speed of the rotor and provided with first and second sensing apertures arranged on a circular track, wherein the sensing apertures scan connecting apertures which are arranged on a circular track, are fixed with respect to the housing, are each connected to a displacement cell and have the same angular spacing, and wherein the sensing apertures are connected to two annular grooves each communicating with one actuating chamber. A very simple construction is obtained by combining the two sensing valves.

The cover at the end of the machine may receive the regulating valve and the valve plate and between the cover and the stator-rotor arrangement there may be disposed a plate which is fixed with respect to the housing and in which there are formed connecting passages extending between the displacement cells and connecting apertures. This results in a space-saving construction with very short connecting paths.

To carry along the valve plate, it is recommended to provide it with an eccentric hole in which a centric extension of the cardan shaft engages.

Two sensing apertures are preferably symmetrically arranged in the valve plate in such a way that, when the first sensing aperture is in registry with a connecting aperture, they are disposed on the confronting sides of two valve apertures substantially edge-to-edge with same. In the one direction of rotation one of the two sensing apertures becomes effective and in the other direction of rotation the other sensing aperture becomes effective.

The adjusting apparatus may comprise two webs on the shaft, which sealingly engage in operating chambers on the rotary slide and each separate two adjusting chambers from one another that are to be associated with two different connections.

Figure 2A:
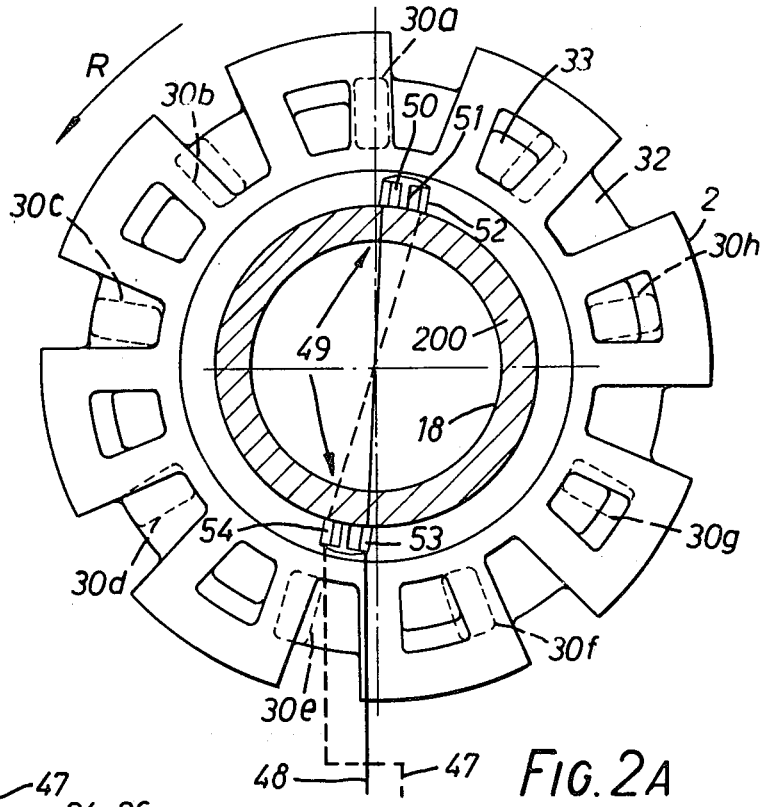
Figure 2B:
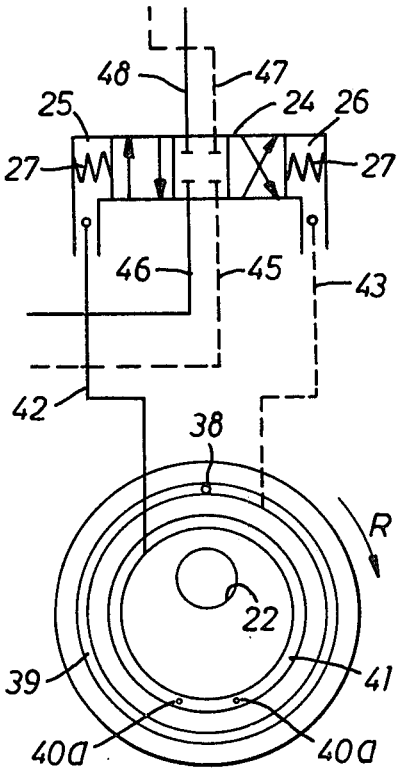
Figure 3:
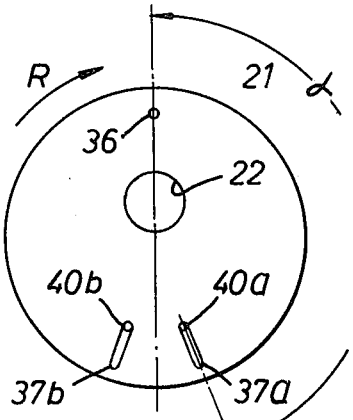
Figure 4:
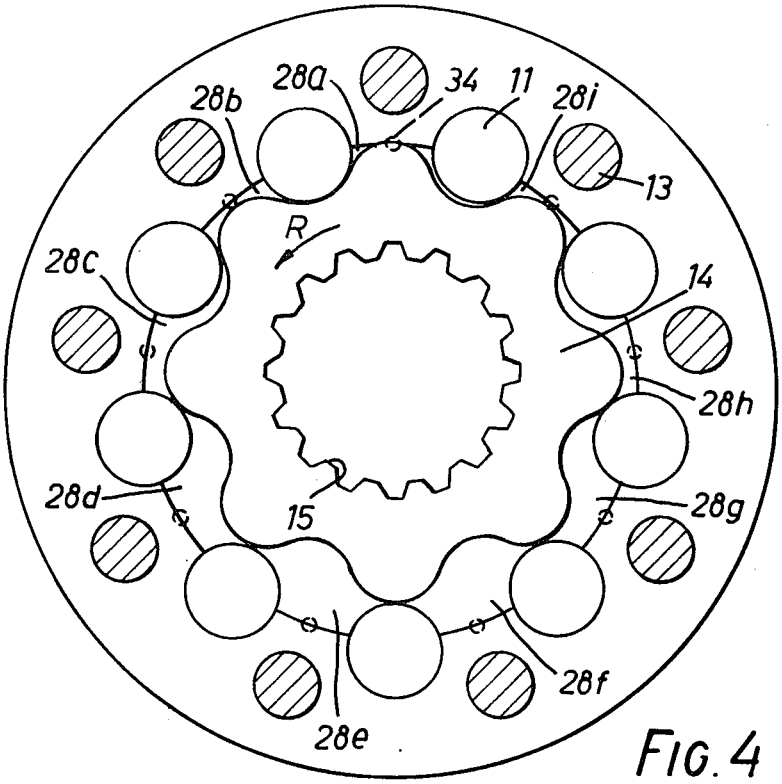
Figure 5:
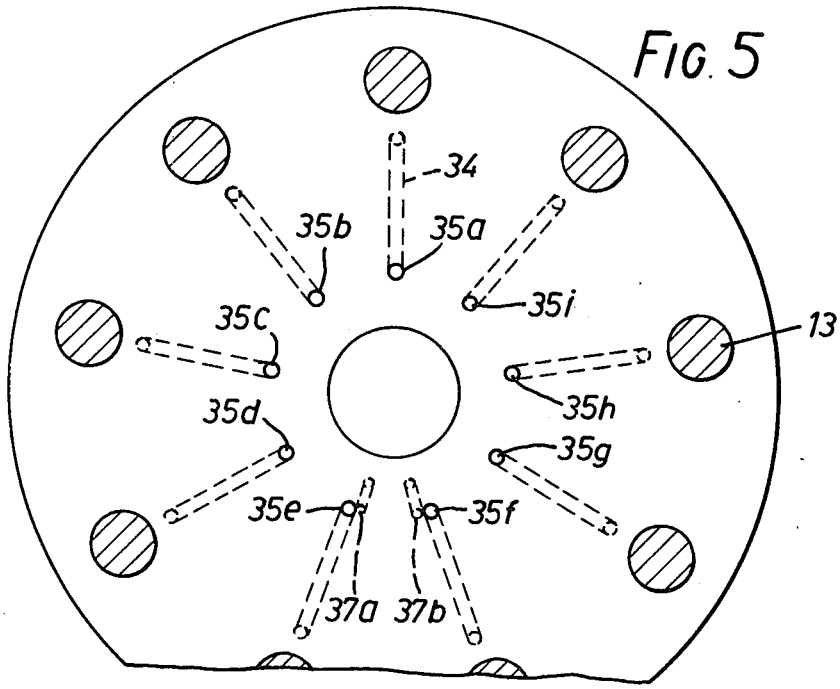

The invention will now be described in more detail with reference to an example illustrated in the drawing. In the drawing:

FIG. 1 is a side elevation, partly in longitudinal section through a circular piston motor according to the invention, FIG. 2A is a section on the plane 2A—2A in FIG. 1 with an end elevation of the rotary slide, FIG. 2B is an end elevation of the valve plate viewed from the plane 2B—2B in FIG. 1 and of its connections, FIG. 3 is an end elevation of the valve plate from the plane 3—3 in FIG. 1, FIG. 4 is a section on the line 4—4 in FIG. 1 and FIG. 5 is a section on the line 5—5 in FIG. 1.

The motor comprises a housing 100 in which a motor shaft 200 is mounted and a rotary slide 2 rotates. Two connections 3 and 4 are provided in the housing which are in communication with annular chambers 5 and 6. The arrows indicate that the connection 4 is supplied with pressure fluid whilst the connection 3 serves for the exhaust. A passage plate 8 is connected to the housing by screws 7. There follows a stator 9 in the form of a hollow wheel assembled from a ring and gear rollers 10, a plate 11 fixed with respect to the housing, and a cover 12, which are clamped together and to the passage plate 8 by means of screws 13 with the interpositioning of sealing rings. a rotor 14 in the form of a pinion is arranged in the stator 9. Engaged in the internal teeth 15 thereof, there is the serrated head 16 of a cardan shaft 17 which passes through a cavity 18 of the motor shaft 200 and the other serrated head 19 of which engages with teeth 20 of the motor shaft 200. A valve plate 21 is mounted in the cover 12 and has an eccentric hole 22 in which a centric extension 23 of the cardan shaft 17 is engaged to be carried along thereby. Further, a three-position regulating valve 24 is provided in the cover, which valve has two actuating chambers 25 and 26 (FIG. 2) and is held in its neutral position by springs 27.

Between the nine rollers 11 of the stator 9 and the eight teeth of the rotor 14 there are nine displacement cells **28*a*–28*i*, of which the cell 28*a* is momentarily the displacement cell of smallest volume. Each displacement cell communicates with an associated valve aperture 30*a*–30*i* through a passage 29 in the passage plate, the valve apertures being alternately swept by the apertures 31 of passages 32 and 33 in the rotary slide 3. Nine passages 29 are opposite eight respective passages 32 which are connected to the annular groove 6 and opposite eight passages 33 which are connected to the annular grove 5. On the other side of the displacement cells, connecting passages 34 in the plate 11 extend to connecting apertures 35*a*–35*i* which are disposed on a circular track with equal angular spacings. These connecting apertures are scanned by a first sensing aperture 36 and two second sensing apertures 37*a* and 37*b* on the valve plate 21. The first sensing aperture 36 communicates with an annular groove 39 by way of a passage 38 and the second sensing apertures 37*a* and 37*b* communicate with an annular groove 41 by way of passages 40*a* and 40*b*. Passages 42 and 43 formed in the cover 12 extend from these annular grooves to the two actuating chambers 25 or 26 of the regulating valve 24**.

The regulating valve is further connected by a conduit 45 to the connection 3 and by a conduit 46 to the connection 4. Two conduits 47 and 48 which are only partially indicated in broken lines in FIG. 1 lead from the regulating valve 24 by way of conventional annular grooves and distributing holes to the adjusting apparatus 49. This consists of two webs 50 fixed to the motor shaft 200, each provided with a sealing ring 51 and engaging in operating chambers 52 in the form of wider axial grooves in the rotary slide 2, which wider grooves are thereby each sub-divided into two adjusting chambers 53 and 54. If pressure fluid is now supplied through the connection 4, it passes through the annular groove 6 and the passages 32 in the rotary slide 2 to the apertures 31 which co-operate with the valve apertures **30*a*–30in the manner indicated above in FIG. 2. Consequently the displacement cells 28*b*–28*e* receive pressurised operating medium through the passages 29. This leads to rotation of the rotor in the direction of the arrow R. This direction of rotation R is also indicated in FIGS. 2 and 3. The displacement cells 28*f*–28*i* are connected by way of the passages 29 in the passage plate 8 and the passges 33 in the rotary slide 2 are connected to the annular groove 5 and the connection 3 so that the low or exhaust pressure obtains therein. In the displacement cell 28*a* of smallest volume, switching over from low pressure to pressure should take place in the illustrated neutral position. If the pressure is applied to the connection 3 and the exhaust to the connection 4**, the motor will rotate in the opposite direction. If the machine is operated as a pump, analogous conditions are obtained.

In general, the rotary slide 2 lags behind the rotor 14 in the case of a motor. This means that switching over from low pressure to pressure takes place too late in the displacement cell 28*a* of smallest volume. This is compensated as follows. Shortly before reaching the neutral position, the first sensing aperture 36 communicates with the connecting aperture 35*a* associated with the displacement cell 28*a*. Precisely in the neutral position, the second sensing aperture 37*a* communicates with the connecting aperture 35*e*. For this purpose the sensing apertures 37*a* and 37*b* are offset relatively to the first sensing aperture 36 by an angle $\alpha$ which is equal to a multiple of the angular spacing between adjcent connecting apertures 35 plus an additional angle which is substantially equal to the sum of half the widths of a connecting aperture 35 and a second sensing aperture 37. This means that in the neutral position of the rotor 14 in relation to the displacement cell 28*a* of smallest volume, the second sensing apertures lie edge-to-edge with the associated connecting aperture 35*e* or 35*f*.

As soon as the neutral position has been reached, a connection is created by way of the second sensing aperture 37*a* of the second sensing valve between the displacement cell 28*e* and the actuating chamber 25 of the regulating valve 24. Since the displacement cell 28*e* contains pressure, pressure also obtains in the actuating chamber 25. Since at this time the displacement cell 28*a* of smallest volume is already in communication with the second actuating chamber 26 of the regulating valve 24 by way of the first sensing aperture 36 and since low pressure still obtains in this displacement cell because of the lag of the rotary slide 2, the actuating chamber 26 is also under low pressure. The regulating valve 24 is therefore displaced towards the right (in FIG. 2). The chamber 53 of the adjusting apparatus 49 now receives pressure whilst the chamber 54 is connected to the exhaust. The rotary slide 2 is therefore turned in the anti-clockwise direction. As soon as switching over to pressure has taken place in the displacement cell 28*a* of smallest volume, pressure will also obtain in the actuating chamber 26, whereby the regulating valve 24 again returns to the neutral blocking position. In the blocking position the chambers 53 and 54 of the adjusting apparatus 49 are closed. The signal impulse occasioned by the two pressure changes has therefore ensured that the rotary slide was turned a certain amount in the compensating direction. The sensing apertures 36 and 37 are subsequently closed by the smooth side wall of the plate 11. Consequently the actuating chambers 25 and 26 are also closed so that the regulating valve 24 retains its position. This is repeated if, after one cycle, the displacement cell 28*i* has become the displacement cell of smallest volume. The signal impulse is now shorter because of the compensation. After a few impulses at the most, the rotary slide 3 runs accurately in phase with the rotor Upon reversal of the direction of rotation, in which the pressure conditions in the supply conduits and in the conduits 45 and 46 are also reversed, the second sensing aperture 37*b* is effective instead of the second sensing aperture 37*a*. In other respects, the conditions are the same.

If the machine is to be operated as a pump, analogous conditions obtain. Desirably, a displacement cell of largest volume is in this case connected to the actuating chamber 26 so that this cell is switched over from low pressure to pressure. Since the rotary slide generally precedes in the case of a pump, the regulating valve 24 is energised already prior to the neutral position and is returned to its blocking position in the neutral position.

I claim:

1. A rotary piston machine comprising a casing having interchageable fluid inlet and outlet ports, an internally toothed stator member and an eccentrically disposed externally toothed rotor member in meshing engagement, said rotor member having rotational movement about its own axis and orbital movement about the axis of said stator member with the teeth of said members intermeshing in sealing engagement to form expanding cells on one side of the line of eccentricity and contracting cells on the other side of said line during relative movement between said members, said casing having passages extending to said cells, drive shaft means in said casing connected to said rotor, distributing valve means between said ports and said passages, two way pressure responsive motor means connectin said distributing valve means to said shaft means allowing limited relative motion therebetween, two way pressure responsive control valve means connected to said inlet and outlet ports and said motor means for selectively actuating said motor means in either direction to change the positional setting of said distributing valve means relative to said shaft means, a stationary plate adjacent said rotor and stator members having circumferentially arranged sensing orifices in respective proximity to said cells, a sensing valve engaging said plate and being connected in driving relation to said shaft means for rotation at the orbiting speed of said rotor member, a first sensing port in said sensing valve on the line of eccentricity thereof and dual sensing ports straddling said line of eccentricity, said first sensing port being connected to one side of said control valve means and said dual sensing ports being connected to the other side of said control valve means, said sensing ports being cooperable with said sensing orifices to determine if said distributing valve means is in phase with said rotor member and to compensate if necessary by actuating said control valve means which in turn actuates said motor means for adjusting said distributing valve means relative to said shaft means.

2. A rotary piston machine according to claim 1 including spring means for holding said control valve means in a central blocking position preventing fluid passage between the inlet and outlet ports and the motor means.

3. A rotary piston machine according to claim 2 including actuating chambers for said control valve means, said control valve means being adjustable by the difference in pressures in said actuating chambers, said first sensing port temporarily connecting one of said cells in an extreme volume state to one of said actuating chambers and one of said dual sensing ports temporarily connecting a pressurized one of said cells to the other of said actuating chambers at the instant of the neutral position.

* * * * *